United States Patent [19]

Hsu et al.

[11] Patent Number: 4,725,962

[45] Date of Patent: Feb. 16, 1988

[54] MELT EJECTION PRESSURE CONTROL SYSTEM FOR THE MELT SPINNING PROCESS

[75] Inventors: Shih-Chen Hsu, Weston; Ralph P. Adler, Wellesley, both of Mass.

[73] Assignee: GTE Laboratories Incorporated, Waltham, Mass.

[21] Appl. No.: 852,998

[22] Filed: Apr. 17, 1986

[51] Int. Cl.[4] ..... G06F 15/46; B22D 11/00

[52] U.S. Cl. ..... 364/476; 164/452; 164/463; 164/475; 266/80

[58] Field of Search ..... 364/472, 476; 164/4.1, 164/449–463, 154–157, 413–415, 259, 418, 423, 427, 429, 475; 266/78, 80, 96, 97, 200, 220, 223, 236

[56] References Cited

U.S. PATENT DOCUMENTS

| | | | |
|---|---|---|---|
| 3,478,808 | 11/1969 | Adams | 364/476 X |
| 3,977,255 | 8/1976 | Groleau et al. | 364/476 X |
| 4,064,925 | 12/1977 | Fastner et al. | 164/66.1 |
| 4,282,921 | 8/1981 | Liebermann | 164/463 |
| 4,449,568 | 5/1984 | Narasimham | 164/453 |
| 4,597,048 | 6/1986 | Mazur et al. | 364/476 X |

*Primary Examiner*—Joseph Ruggiero

*Attorney, Agent, or Firm*—Hamilton, Brook, Smith & Reynolds

[57] ABSTRACT

A method and apparatus for maintaining a constant ejection pressure in a melt spinning process for converting a molten metal into a metal foil of a uniform thickness. The backpressure exerted against inert gas being injected into the bottom of a crucible containing molten metal is monitored. Any negative rate change in the backpressure is noted and the gas overpressure in the crucible is then increased to return the back-pressure to its original value. In another embodiment the gas flow rate of the inert gas is monitored. Any positive rate change in the flow rate is noted and the gas overpressure is then increased to return the flow rate of the gas back to normal. This maintains a constant ejection pressure of molten metal passing through the orifice of the crucible producing foil with a uniform thickness.

21 Claims, 1 Drawing Figure

MELT EJECTION PRESSURE CONTROL SYSTEM FOR THE MELT SPINNING PROCESS

FIELD OF THE INVENTION

This invention is in the field of rapid solidification metallurgy. More particularly, it relates to a process for controlling the melt ejection in a melt spinning process.

BACKGROUND OF THE INVENTION

A melt spinning process is a one-step process to convert molten alloy into a solid foil. In this process, a metal ingot is melted in an enclosed crucible producing molten metal. The bottom of the crucible has an orifice or a series of orifices spaced across a rotating quenching wheel which lies directly beneath the crucible. The molten metal in the crucible is ejected as a stream of molten metal through the orifice(s) onto the rotating quenching wheel. This stream forms a puddle from which thin foil is continuously solidified at the interface of the puddle and the rotating wheel. The molten metal is ejected from the orifice(s) of the crucible by pressure caused by the hydrostatic head height of the molten metal and by gas overpressure. The gas producing the overpressure is injected through an opening at the top of the crucible over the molten metal in the crucible.

The dimensions of the finished metal-foil product are determined by both the dimension and flow rate of the stream of molten metal which is ejected through the orifice(s) of the crucible and by the characteristics of the rotating quenching wheel, i.e., its size, rotational mean interface speed, temperature and composition. The cross-sectional dimensions of the stream of molten metal are determined by the dimensional characteristics of the orifice(s) at the bottom of the crucible. Generally, the width of the foil is about the same as the long dimension of a slotted orifice or the length of a spaced array of circular orifices at the bottom of the crucible aligned perpendicular to the direction of movement of the rotating wheel.

The effective ejection pressure of the molten metal is one of the major factors determining the thickness of the metal foil produced. In other words, the foil thickness in a continuous run will vary if the effective ejection pressure is not kept at a constant level. This effective ejection pressure $P_{eject}$, is composed of the sum of the overpressure produced by the inert gas applied to the melt, $P_{gas}$, and the pressure caused by the hydrostatic head height of the melt itself, $P_{melt}$ i.e., $P_{eject}=P_{gas}+P_{melt}$.

During the course of a run, $P_{melt}$ will decrease due to the continuous reduction of the head height of an unrecharged molten metal source. If this decrease in $P_{melt}$ is not compensated for, $P_{eject}$ will also decrease which will cause a continual decrease in the thickness of the metal foil from the beginning to the end of the run. Therefore, in order to compensate for the continuous decrease of $P_{melt}$, a means for a controlled increase of $P_{gas}$ is needed in order to maintain a constant effective ejection pressure. Commercially available pressure sensors have not been designed to withstand immersion into hot molten metals, which for the case of AMS 4778 Ni-base alloy is about 1100° C. The conventional approach is to first calculate or estimate the time rate of change for $P_{melt}$. When $$\frac{d\,P_{melt}}{dt}$$

estimated or calculated then a controlled increase of $P_{gas}$ using available commercial instruments is attempted to maintain the instantaneous rate for $$\frac{d\,P_{gas}}{dt}$$

remains zero. But, the relationship between $P_{gas}$ and $P_{melt}$ depends on the initial height and density of the molten metal charge, the size and shape of both the crucible vessel and the orifice. In other words, $$\frac{d\,P_{melt}}{dt}.$$

is a variable that must be calculated for every different kind of run in order to program the increase in $P_{gas}$ to hold $P_{eject}$ constant. This is a complicated, tedious approach which has not reliably produced metal foil with end to end thickness uniformity.

SUMMARY OF THE INVENTION

In accordance with this invention, a method of measuring $P_{eject}$ directly in a melt spinning process without requiring knowledge or measurement of the exact values for $P_{melt}$ or $P_{gas}$ is disclosed. A tube having a free end and an end connected to a gas connection is positioned with its free opening near the bottom of the crucible. Inert gas is forced at a predetermined flow rate through the tube and the inert gas bubbles out of the tube into the melt. The effective pressure exerted by the hydrostatic head height of the molten metal in combination with the applied gas overpressure in the upper volume of the crucible produces a backpressure opposing the flow of inert gas through the ceramic tube. Any decrease in this backpressure due to the reduction in the hydrostatic head height of the molten metal in the crucible can be detected by measuring the resultant increase in the gas flow rate traveling through the tube or by measuring the resultant reduction in the backpressure being exerted against the gas flow.

This system can thus act as a pressure sensor to detect $P_{eject}$ directly. Furthermore, a closed loop logic control system is disclosed which converts this measurement of a changed $P_{eject}$ into a suitable signal to cause a gas flow regulator to raise $P_{gas}$ in order to maintain a fixed $P_{eject}$.

DETAILED DESCRIPTION OF THE INVENTION

Figure 1:
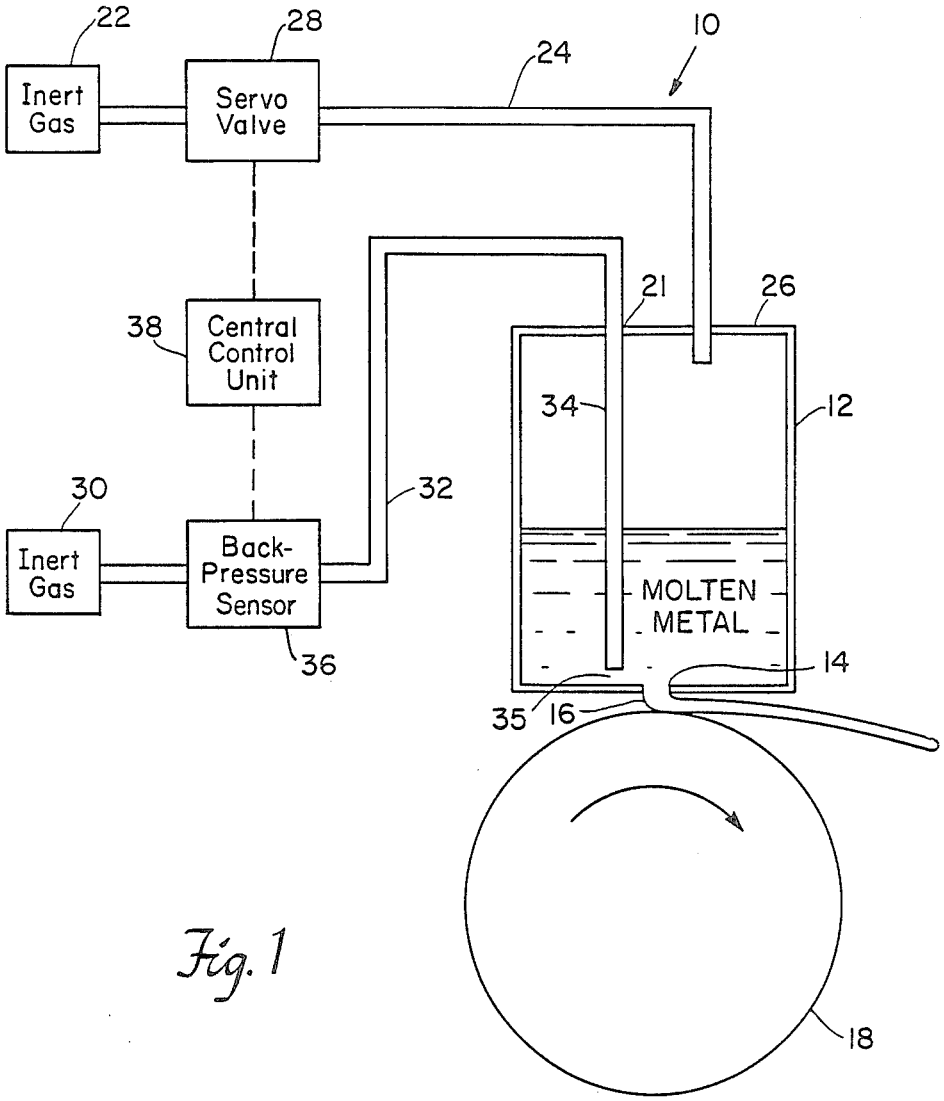
FIG. 1 illustrates schematically a melt spinning apparatus suitable for converting molten metal alloy into a solid foil. The apparatus contains a means for maintaining the melt ejection pressure at a constant value according to this invention.

This invention comprises a method and apparatus for measuring and controlling the ejection pressure on the molten metal in a melt spinning process. During a melt spinning run, an ingot of metal is melted in a closed crucible and the resultant molten metal is ejected through an orifice in the bottom of the crucible onto a rotating wheel where the molten metal sequentially cools and solidifies producing a continuous length of metal foil.

According to this invention, a ceramic tube is placed vertically into the crucible with its open end near the bottom of the crucible. Any tube is suitable if it is inert toward and will not contaminate the molten metal. Inert gas is forced at a fixed rate into the ceramic tube and the gas bubbles into the molten metal. The pressure exerted by the hydrostatic head height of the molten metal in combination with any gas overpressure applied in the upper volume of the closed crucible produces a backpressure against the flow of this inert gas passing through the ceramic tube. Any decrease in the backpressure due to the reduction in the hydrostatic head height of the decreasing volume of molten metal in the crucible is detected by a flow and/or backpressure sensor. Any decrease in the backpressure opposing the flow of the inert gas passing through the ceramic tube into the molten metal corresponds to a decrease in $P_{eject}$.

Any such decrease in the backpressure opposing the flow of inert gas is monitored so that the gas overpressure on the molten metal can be accordingly increased to compensate for any decreases in the effective ejection pressure. This increase in gas overpressure compensates for the drop in ejection pressure due to the lowering of the hydrostatic head height of the molten metal as it empties from the crucible and forms metal foil. Also, this increase in gas overpressure increases the backpressure exerted against the inert gas being through the ceramic tube returning this flow rate to its original value. These process adjustments thus maintain a constant mass flow rate of the molten metal passing through the orifice at the bottom of the crucible leading to the production of foil with end to end thickness uniformity.

This process is illustrated by the apparatus shown in FIG. 1. The melt-spinning apparatus 10 of FIG. 1 is comprised of crucible 12 in which metal ingot is melted producing molten metal. Crucible 12 has an orifice 14 through which the molten metal is ejected. The melt stream of molten metal 16 is deposited onto a rotating quenching wheel 18 from which a thin foil 20 is solidified in a continuous form.

Gas supply 22 provides inert gas by way of gas line 24 into crucible 12 through an opening in the top 26 of the enclosed crucible. This inert gas produces a gas overpressure above the molten metal. The gas overpressure together with the pressure exerted by the hydrostatic head height of the molten metal in the crucible may produce a flow of molten metal through orifice 14 of crucible 12. The ejection pressure of the molten metal through orifice 14 is one of the major factors determining the thickness of the metal foil produced. To obtain foil having uniform thickness, it is necessary to maintain a constant ejection pressure on the molten metal. The ejection pressure is monitored and regulated by a closed loop control logic system which is comprised of backpressure sensor 36, central control unit 38 and electronic servo valve 28. Electronic valve 28 regulates the gas flow rate from gas supply 22 to the upper volume of crucible 12, and thus the gas overpressure on the molten metal in crucible 12.

Gas supply 30 sends inert gas through gas line 32 into ceramic tube 34. In a preferred embodiment, the inner diameter of the ceramic tube is between $\frac{1}{8}$–$\frac{1}{4}$" and the flow rate of inert gas through said tube is approximately 0.05–0.5 liter/minute. Ceramic tube 34 is positioned vertically in crucible 12 through inlet 25 of cover 26. Ceramic tube 34 has an open end 35 positioned near the bottom of crucible 12 near orifice 14.

Inert gas from gas supply 30 is forced through line 32 into ceramic tube 34 and bubbles out the tube's open end 35 into the molten metal in crucible 12. Backpressure sensor 36 measures the backpressure to this flow. The backpressure is produced by the gas overpressure and the pressure produced from the hydrostatic head height of the remaining molten metal. When the inert gas flow rate through tube 34 is set at a fixed level, any decrease in the level of molten metal within crucible 12 will reduce the backpressure exerted against said inert gas flow. Backpressure sensor 36 detects this change in backpressure and sends a pneumatic signal to central control unit 38 which converts the pneumatic signal into an electronic signal. This electronic signal is relayed to electronic servo valve 28. The electronic signal causes electronic servo valve 28 to allow sufficient additional gas to flow through line 24 into the upper volume of crucible 12 in order to increase the gas overpressure in crucible 12. This additional gas pressure over the molten metal returns the effective backpressure against the flow of gas through tube 34 to its original pre-set pressure. In the apparatus of FIG. 1, backpressure sensor 36 produces a pneumatic signal. However, an electronic backpressure sensor can also be used. Such a backpressure sensor sends an electronic signal directly to the central control unit which relays it to the electronic servo valve.

Because the backpressure exerted against the inert gas from gas supply 30 through ceramic tube 34 correlates with the ejection pressure of the molten metal through orifice 14 in crucible 12, means to keep the backpressure constant will maintain the ejection pressure constant and, thus, the flow rate of the molten metal through orifice 14 will be maintained at a fixed value. The maintenance of a constant flow rate of molten metal through orifice 14 will produce metal foil having a uniform thickness. By uniform thickness it is meant that the thickness variation is less than $\pm 10\%$ from start to finish.

In summary, the molten metal delivery rate can be kept constant by the controlled increase of inert gas overpressure on the molten metal to compensate for the decreasing hydrostatic head height pressure as the molten metal empties from the crucible. This instantaneous gas overpressure control is used to maintain the ejection pressure constant and in turn is based on system adjustments to keep the back-pressure constant. The above-described ejection pressure detection system should be operable even under the adverse high temperature conditions that are present when handling molten metal alloys and is implemented to achieve the goal of producing foils with uniform thickness throughout the duration of a melt spinning run.

This process is illustrated by the following example.

EXAMPLE 1

Production of a Nickel-base Alloy Foil

Materials Used 5-pound Ni-base alloy charge (Nominal Composition by weight 92.6% Ni, 4.5 wt % Si, 2.9 wt % B). An apparatus as described in FIG. 1 having the following elements:

An 8 inch high 2 inch diameter cylindrical crucible of fused silica having a rectangular orifice opening 1 inch by 0.02 inch at the bottom of the crucible;

An 8 inch diameter internally water cooled, copper quenching wheel;

A ceramic tube 8" high, ⅛" inner diameter passing through a stainless steel cover plate; and Plastic tubings.

Procedure

A 1-inch by 0.0015 inch (rectangular cross-section) continuous Ni-base alloy ribbon was produced by first inductively melting the alloy ingot in the crucible. The total ejection pressure needed to produce the desired Ni-base alloy ribbon was 2.5 psi. At the start of the run, this ejection pressure was produced by the pressure exerted by the hydrostatic head height of the molten metal which was 1.6 psi and an initial gas overpressure of 0.9 psi. In order to obtain a Ni-base alloy ribbon with uniform dimension along its entire length, it was necessary to maintain an effective ejection pressure of 2.5 psi throughout the run.

The gas overpressure was increased from 0.9 psi at the beginning of the run to 2.5 psi by the end of the run in order to maintain a constant total pressure of 2.5 psi. This was automatically carried out using a closed loop control logic system. The closed loop control logic system was comprised of a backpressure sensor, a central control unit and an electronic servo valve.

The backpressure sensor detected the backpressure being exerted against the inert gas which was injected through the ceramic tube at 0.1 liter/minute. The backpressure sensor was capable of detecting the drop in backpressure due to the loss in pressure caused by the continual lowering of the hydrostatic head height of the continual decreasing supply of molten metal.

The backpressure sensor measurements were continuously sent as pneumatic signals to the central control unit (the central control unit used here was the combination of an analog-to-digital converter, a microprocessor and an electronic valve controller). The central control unit converted these pneumatic signals into electronic signals which were sent to an electronic servo valve. These signals continuously drove the electronic servo valve further open to allow more gas to flow into the upper section of the crucible. This continuously increased the gas overpressure so as to compensate for the loss in pressure due to the lowering of the hydrostatic head height of the molten metal as it emptied out of the crucible as the melt spinning process progressed.

By continuously compensating for the decrease in hydrostatic head pressure due to the continual lowering of the melt level of the molten metal, a constant ejection pressure was able to be maintained. Thus, this dynamic feedback mechanism was able to automatically increase the gas overpressure from 0.9 psi at the beginning of the run to 2.5 psi at the end of the run. Thus, a constant total ejection pressure of 2.5 psi was maintained. This produced a foil of uniform thickness with a variance in thickness of about 8%.

Equivalents

Those skilled in the art will recognize, or be able to ascertain using no more than routine experimentation, many equivalents to the specific embodiments of the invention described herein. Such equivalents are intended to be encompassed by the following claims.

We claim:

1. In a method for melt spinning molten metal to produce metal foil in which metal ingot is melted in a crucible, the resultant molten metal producing a certain hydrostatic head pressure at the bottom of the crucible, said crucible containing a top cover enclosing the crucible, said cover having an inlet through which a gas supply line is positioned to provide pressurized inert gas to the upper volume of the crucible over the molten metal, said gas producing a gas overpressure on the molten metal, the inert gas producing said gas overpressure being supplied by a gas supply attached to the gas supply line, said crucible containing an orifice at the bottom of said crucible through which molten metal can be ejected, the molten metal being ejected as a stream onto a rotating wheel by a pressure determined by the sum of the pressure produced by the hydrostatic head height of the molten metal and the gas overpressure in the crucible thus producing metal foil, the improvement comprising:

(a) injecting inert gas at a known, fixed, flow rate near the orifice at the bottom of the crucible, the molten metal producing a backpressure against said flowing inert gas, said backpressure being equal to the sum of the pressure produced by the hydrostatic head height of the molten metal and the gas overpressure;

(b) measuring the backpressure being exerted against the inert gas which is being injected near the bottom of the crucible; and (c) increasing the gas overpressure in the crucible whenever the backpressure against the inert gas which is being injected into the bottom of the crucible decreases until the backpressure against said inert gas returns to the value at which said backpressure was originally set, thus maintaining a constant ejection pressure on the molten metal being forced through the orifice at the bottom of the crucible.

2. The improvement of claim 1, wherein the inert gas of step "a" is injected into the bottom of the crucible by means of a ceramic tube, said ceramic tube being positioned vertically into the crucible through an inlet in the enclosure at the top of the crucible, said ceramic tube having an open end which is positioned near the orifice at the bottom of the crucible.

3. The improvement of claim 1, wherein the backpressure being exerted against the inert gas being injected into the bottom of the crucible is measured by means of a backpressure sensor.

4. The improvement of claim 1, wherein the flow rate of the gas producing the gas overpressure over the molten metal in the crucible is regulated by an electronic servo valve.

5. The improvement of claim 1, wherein instead of measuring the backpressure being exerted against the inert gas which is being injected near the bottom of the crucible in step "b", the flow rate of said inert gas is measured, and the gas over-pressure of the crucible is increased whenever the flow rate of the inert gas being injected to the bottom of the crucible increases, said gas over-pressure being increased until the flow rate of said inert gas returns to the rate at which said gas was originally set, thus maintaining a constant ejection pressure on the molten metal being forced through the orifice at the bottom of said crucible.

6. The improvement of claim 1, wherein the backpressure against the inert gas that is being injected to the bottom of the crucible is monitored and the gas overpressure over the molten metal in the crucible is automatically increased whenever the backpressure against said inert gas decreases by means of a closed loop control logic system, said closed loop control logic system being comprised of:

(a) a backpressure sensor monitoring the backpressure being exerted against the inert gas being injected to the bottom of the crucible;

(b) an electronic servo valve for regulating the flow of the gas producing the overpressure on the molten metal in the upper volume of the crucible; and (c) a central control unit which converts pneumatic pressure signals into electronic signals, said central control unit being between and attached to the backpressure sensor and the electronic servo valve, wherein as the backpressure sensor detects any decrease of backpressure against the inert gas being injected into the bottom of the crucible, said backpressure sensor sends a pneumatic signal to the central control unit, said central control unit transforms the pneumatic signal into an electronic signal and transmits said electronic signal to the electronic servo valve, said electronic signal causing said electronic servo valve to open further to allow sufficient additional gas to flow into the upper volume of the crucible to increase the gas overpressure on the molten metal in the crucible, thus returning the backpressure exerted against the inert gas flowing to the bottom of the crucible back to its original backpressure value thus keeping a constant ejection pressure over the molten metal being forced through the orifice at the bottom of the crucible.

7. The improvement of claim 6, wherein the closed loop control logic system contains a gas flow rate sensor which measures the flow rate of the inert gas flowing through the ceramic tube instead of a backpressure sensor, wherein said gas flow rate sensor sends an electronic signal to the central control unit whenever the gas flow rate of the inert gas being injected to the bottom of the crucible increases due to the lowering of the backpressure against said inert gas, the central control unit relays this signal to the electronic servo valve which causes said electronic servo valve to open further to allow sufficient additional gas to flow into the upper volume of the crucible to increase the gas overpressure over the molten metal in the crucible to return the backpressure exerted against the inert gas flowing to the bottom of the crucible back to its original value, thus maintaining a constant ejection pressure over the molten metal being forced through the orifice at the bottom of the crucible.

8. The improvement of claim 6, wherein the backpressure sensor is an electronic backpressure sensor which sends electronic signals to the central control unit when the backpressure against the inert gas being injected to the bottom of the crucible decreases.

9. In a method for melt spinning molten metal to produce metal foil in which a metal ingot is melted in a crucible, the resultant molten metal producing a certain hydrostatic head pressure at the bottom of the crucible, said crucible containing a top cover enclosing the crucible, said cover having an inlet through which a gas supply line is positioned to provide pressurized inert gas to the upper volume of the crucible over the molten metal, said gas producing a gas overpressure over the molten metal, the inert gas producing said gas overpressure being supplied by a gas supply attached to the gas supply line, said crucible containing an orifice at the bottom of the crucible through which molten metal can be ejected, the molten metal being ejected onto a rotating wheel by a pressure determined by the sum of the pressure produced by the hydrostatic head height of the molten metal and the gas overpressure in the crucible, thus, providing metal foil; the improvement comprising:

(a) placing a ceramic tube with a gas supply line attached to it vertically into the crucible through an additional inlet in the cover at the top of the crucible, said ceramic tube containing an open end, the open end of said ceramic tube being placed near the orifice at the bottom of said crucible;

(b) passing inert gas at a predetermined rate through said ceramic tube, the molten metal in the crucible producing a backpressure against the flow of the inert gas through said ceramic tube, said backpressure being equal to the sum of the pressure produced by the hydrostatic head height of the molten metal and the gas overpressure;

(c) increasing the gas overpressure in the crucible automatically by means of a closed loop control logic system whenever the backpressure against the inert gas decreases, said closed loop control logic system comprising:

(i) a backpressure sensor monitoring the backpressure exerted against the inert gas passing through the ceramic tube;

(ii) an electronic servo valve for regulating the flow of the overpressure gas being supplied to the upper volume of the crucible over the molten metal; and (iii) a central control unit which converts pneumatic signals into electronic signals, said central control unit being connected to the backpressure sensor and to the electronic valve, wherein:

the backpressure sensor detects any decrease in backpressure being exerted against the inert gas flowing through the ceramic tube and sends a pneumatic signal to the central control unit, said central control unit transforming the pneumatic signal into an electronic signal and sending the electronic signal to the electronic servo valve, the electronic signal driving the electronic servo valve to open further and admit sufficient additional gas to flow into the upper volume of the crucible to increase the gas overpressure over the molten metal in the crucible, thereby returning the backpressure exerted against the inert gas going through the ceramic tube back to the initially set backpressure level and, thus, maintaining a constant ejection pressure on the molten metal passing through the orifice at the bottom of the crucible.

10. The improvement of claim 9, wherein the closed loop control logic system contains a gas flow rate sensor which measures the flow rate of the inert gas flowing through the ceramic tube instead of a backpressure sensor, wherein said gas flow rate sensor sends an electronic signal to the central control unit whenever the gas flow rate increases due to a lowering of the backpressure being exerted against said inert gas, the central control unit relays this signal to the electronic servo valve which causes said electronic servo valve to open further to allow sufficient additional gas to flow into the upper volume of the crucible to increase the gas overpressure over the molten metal in the crucible to return the backpressure being exerted against the inert gas flowing to the bottom of the crucible back to its original value, thus maintaining a constant ejection pressure on the molten metal passing through the orifice at the bottom of the crucible.

11. In an apparatus for melt spinning molten metal to produce metal foil in which metal ingot is melted in a crucible, the resultant molten metal producing a certain hydrostatic pressure at the bottom of the crucible, said crucible having a cover enclosing the top of the crucible, said cover having an inlet through which a gas supply line is positioned to provide inert gas to the upper volume of the crucible above the molten metal, said inert gas producing a gas overpressure over the molten metal, the inert gas producing said gas overpressure being supplied by a gas supply line attached to a gas supply, said crucible containing an orifice at the bottom of the crucible through which molten metal can be ejected, the molten metal being ejected onto a rotating wheel by a pressure determined by the sum of the hydrostatic head pressure produced by the height of the molten metal in the crucible and the gas overpressure in the crucible, thus, producing metal foil; the improvement comprising:

(a) means for passing inert gas to the bottom of the crucible near the orifice at the bottom of said crucible, wherein inert gas is passed to the bottom of said crucible at a fixed predetermined rate into the molten metal at the bottom of the crucible, said molten metal producing a backpressure against the flow of inert gas, said backpressure being equal to the sum of the pressures produced by the hydrostatic head height of the molten metal and the gas overpressure at the top of said crucible;

(b) means for measuring the backpressure being exerted against the inert gas being injected to the bottom of said crucible;

(c) means for allowing sufficient additional gas to flow into the upper volume of the crucible to increase the gas overpressure in the crucible whenever the backpressure being exerted against the inert gas which is being injected into the bottom of the crucible decreases as indicated by the means for measuring the backpressure being exerted against said inert gas, thus, returning the backpressure of the inert gas to the backpressure value originally set for said gas, thus maintaining a constant ejection pressure on the molten metal being forced through the orifice of the crucible, and, thus, producing metal foil of a uniform thickness.

12. An apparatus as recited in claim 11, wherein instead of a means for measuring the backpressure against the inert gas being injected to the bottom of the crucible, the apparatus contains a means for measuring the gas flow rate of said inert gas, wherein the means for allowing sufficient additional gas to flow into the upper volume of the crucible opens up further to increase the gas overpressure of the crucible whenever the flow rate of the inert gas which is being injected into the bottom of the crucible increases as indicated by the means for measuring the flow rate of said inert gas, thus returning the backpressure against the inert gas to the backpressure value originally set for said gas, thus returning the flow rate of the inert gas being passed to the bottom of the crucible back to its original value and thus maintaining a constant ejection pressure on the molten metal through the orifice of the crucible, and thus producing metal foil of a uniform thickness.

13. The improvement of claim 11, wherein the means for injecting inert gas near the orifice of the crucible at the bottom of said crucible is a ceramic tube positioned vertically into said crucible through an inlet in the enclosure at the top of the crucible, said ceramic tube having an open end positioned near the orifice at the bottom of said crucible, said ceramic tube having a gas supply line attached to it opposite the open end of said tube which is at the top of the crucible, said gas supply line passing gas through said tube.

14. The improvement of claim 11, wherein the means for measuring the backpressure of the inert gas injecteded near the bottom of the crucible is a backpressure sensor.

15. The improvement of claim 11, wherein the means for increasing the gas flow of the gas producing the gas overpressure at the upper volume of the crucible is an electronic servo valve.

16. The improvement of claim 11, wherein the means for monitoring the backpressure of the inert gas injected near the orifice of the crucible and the means for increasing the gas overpressure in the crucible are contained in a closed loop control logic system, said system comprising:

(a) a backpressure sensor monitoring the backpressure being exerted against the inert gas being injected to the bottom of the crucible;

(b) an electronic servo valve for regulating the amount of gas being supplied to the upper volume of the crucible producing a gas overpressure; and (c) a central control unit which converts pneumatic pressure signals into electronic signals, said central control unit being attached to the backpressure sensor and to the electronic valve, such that when the backpressure sensor detects any decrease of backpressure exerted against the inert gas flowing to the bottom of the crucible it sends a pneumatic signal to the central control unit, said central control unit transforms the pneumatic signal into an electronic signal and sends said electronic signal to the electronic valve, said electronic signal causing said electronic servo valve to open further to allow sufficient additional gas to flow into the upper volume of the crucible to increase the gas overpressure in the crucible to compensate for the loss of pressure due to the lowering of the hydrostatic head height of the molten metal, thus returning the backpressure against the inert gas being injected at the bottom of the crucible to the pressure value at which it was originally set, thus keeping the ejection pressure of the molten metal being forced through the orifice at the bottom of the crucible constant.

17. An improvement as recited in claim 16, wherein instead of a backpressure sensor, the closed loop control logic system contains a gas flow rate sensor which monitors the flow rate of the gas flowing through the ceramic tube, wherein said central control unit is attached to the gas flow rate sensor and to the electronic servo valve, such that the gas flow rate sensor detects any increase in the flow rate of the inert gas flowing to the bottom of the crucible and sends an electronic signal to the central control unit; said central control unit relays the electronic signal to the electronic valve, said electronic signal causing said electronic valve to open further to allow sufficient additional gas to flow into the upper volume of the crucible to increase the gas overpressure in the crucible to compensate for the loss of pressure due to the lowering of the hydrostatic head height of the molten metal, thus returning the backpressure against the inert gas being injected to the bottom of the crucible to the pressure value at which it was originally set, thus returning the flow rate of the inert gas back to the rate at which it was originally set, thus maintaining the ejection pressure of the molten metal being forced through the orifice at the bottom of the crucible constant.

18. The improvement of claim 16, wherein the means for monitoring the backpressure of the inert gas is an electronic backpressure sensor which sends electronic signals to the central control unit when the backpressure against the inert gas being injected to the bottom of the crucible decreases.

19. In an apparatus for melt spinning molten metal to produce metal foil in which metal ingot is melted in a crucible, the resultant molten metal having a certain hydrostatic head height in the crucible, said crucible containing a top cover covering the crucible, said cover having an inlet through which a gas supply line is positioned to provide inert gas to the upper volume of the crucible above the level of the molten metal, said gas producing a gas overpressure over the molten metal, the inert gas producing said gas overpressure being supplied by a gas supply attached to the gas supply line, said crucible containing an orifice at the bottom of the crucible through which molten metal can be ejected, said molten metal being ejected onto a rotating wheel by a pressure determined by the sum of pressure produced by the hydrostatic head height of the molten metal in the crucible and the gas overpressure in the crucible, thus, providing metal foil; the improvement comprising:

(a) a ceramic tube attached to an inert gas supply line, said supply line being attached to a supply of gas, said ceramic tube being positioned vertically into the crucible through an inlet in the cover at the top of the crucible, said ceramic tube having an open end, said open end of the ceramic tube being positioned near the orifice at the bottom of the crucible; and (b) a closed loop control logic system, said system comprising:

(i) a backpressure sensor attached to the gas supply line supplying gas to the ceramic tube for monitoring the backpressure against the inert gas being injected to the bottom of the crucible;

(ii) an electronic servo valve attached to the gas supply line which supplies gas to the upper level of the crucible, said electronic servo valve regulating the amount of gas being supplied to the upper volume of the crucible; and (iii) a central control unit which converts pneumatic pressure signals into electronic signals, said central control unit being attached to the backpressure sensor and to the electronic valve, such that whenever the backpressure sensor detects any decrease of backpressure being exerted against the inert gas flowing through the ceramic tube said backpressure sensor sends a pneumatic signal to the control unit, said central control unit transforming the pneumatic signal into an electronic signal and sending the electronic signal to the electronic valve, said electronic signal driving the electronic valve further open to allow sufficient additional gas to flow into the upper volume of the crucible to increase the gas overpressure over the molten metal in the crucible to compensate for the loss of pressure due to the lowering of the hydrostatic head height of the molten metal, thus returning the backpressure exerted against the inert gas flowing through the ceramic tube to the pressure at which it was originally set, thus maintaining the ejection pressure of the molten metal being forced through the orifice of the crucible constant, thus producing metal foil having uniform thickness.

20. An improvement as recited in claim 19, wherein instead of a backpressure sensor, the closed loop control logic system contains a gas flow rate sensor which monitors the flow rate of the gas flowing through the ceramic tube such that said central control unit is attached to the gas flow rate sensor and to the electronic valve, wherein as the gas flow rate sensor detects any increase in the flow rate of the inert gas flowing to the bottom of the crucible said gas flow rate sensor sends an electronic signal to the central control unit, said central control unit sending the electronic signal to the electronic valve, said electronic signal driving said electronic valve further open to allow sufficient additional gas to flow into the upper volume of the crucible to increase the gas overpressure in the crucible to compensate for the loss of pressure due to the lowering of the hydrostatic head height of the molten metal.

21. An improvement as recited in claim 19, wherein the backpressure sensor is an electronic backpressure sensor which sends electronic signals to the central control unit when the backpressure against the inert gas being injected to the bottom of the crucible decreases.

* * * * *